US007731386B2

(12) United States Patent
Levine

(10) Patent No.: US 7,731,386 B2
(45) Date of Patent: Jun. 8, 2010

(54) LIGHTING DEVICE

(76) Inventor: Jonathan E. Levine, 419 Park Ave. South, Suite 505, New York, NY (US) 10016

( * ) Notice: Subject to any disclaimer, the term of this patent is extended or adjusted under 35 U.S.C. 154(b) by 266 days.

(21) Appl. No.: 12/126,881

(22) Filed: May 24, 2008

(65) Prior Publication Data

US 2009/0290335 A1 Nov. 26, 2009

(51) Int. Cl.
*F21L 4/08* (2006.01)
*F21V 7/00* (2006.01)

(52) U.S. Cl. ..... 362/197; 362/249.03; 362/287; 362/371; 362/419; 362/427

(58) Field of Classification Search ..... 362/220, 362/197, 199, 249.03, 249.04, 249.07–249.09, 362/249.1, 285, 287, 288, 371, 418, 419, 362/427, 428
See application file for complete search history.

(56) References Cited

U.S. PATENT DOCUMENTS

| | | | | |
|---|---|---|---|---|
| D130,059 | S | | 3/1941 | Herr |
| 2,345,235 | A | | 3/1944 | Carter, Jr. |
| 2,595,520 | A | | 5/1952 | Guerin |
| 2,790,894 | A | | 4/1957 | Zingone |
| D259,586 | S | | 6/1981 | Johnson |
| D264,254 | S | | 5/1982 | Heritage |
| 4,494,177 | A | | 1/1985 | Matthews |
| D278,461 | S | | 4/1985 | Pepall |
| 4,515,570 | A | | 5/1985 | Beltran |
| 4,527,224 | A | * | 7/1985 | Sangiamo et al. ..... 362/282 |
| D283,645 | S | | 4/1986 | Tanaka |
| D290,294 | S | | 6/1987 | Sano et al. |
| D290,884 | S | | 7/1987 | Sano et al. |
| D293,940 | S | | 1/1988 | Lasker |
| 4,751,627 | A | | 6/1988 | Usher |
| D299,549 | S | | 1/1989 | Macaluso |
| 4,816,969 | A | | 3/1989 | Miller |
| D300,876 | S | | 4/1989 | Sakai |
| D303,848 | S | | 10/1989 | Bianchi |
| D312,136 | S | | 11/1990 | Miletich et al. |
| 4,977,489 | A | | 12/1990 | Fung |
| 5,012,394 | A | | 4/1991 | Woodward |
| D320,863 | S | | 10/1991 | Macaluso |

(Continued)

OTHER PUBLICATIONS

"Fulcrum 113311-301 Flyweight Travel Booklight," http://www.amazon.com/Fulcrum-113311-301-Flyweight-Travel-Booklight/dp/B0006JN7XC, visited Aug. 17, 2007, 1 page.

*Primary Examiner*—Bao Q Truong
(74) *Attorney, Agent, or Firm*—Theodore W. Baker

(57) ABSTRACT

A lighting device is disclosed. The lighting device can include a light bar and a base having an elongated groove shaped to receive the light bar. The light bar can be rotatable relative to the base around an axis substantially perpendicular to the long axis of the light bar. Rotation of the light bar around this axis can move the light bar into and out of the elongated groove, thus converting the lighting device between compact and expanded configurations. For greater maneuverability, the light bar can include a light source housing portion rotatable around an axis substantially parallel to the long axis of the light bar. The light source housing portion can include two or more light emitting diodes positioned along the long axis of the light bar. The lighting device can be used with a mounting sleeve shaped to receive, for example, one end of the base.

20 Claims, 4 Drawing Sheets

U.S. PATENT DOCUMENTS

D322,681 S 12/1991 Yuen
D327,334 S 6/1992 Parker
D330,269 S 10/1992 Hong
5,169,226 A 12/1992 Friedman
5,265,000 A 11/1993 Lin
D350,620 S 9/1994 Yuen
D356,647 S 3/1995 Jung
5,410,457 A * 4/1995 Parker ..... 362/205
D357,993 S 5/1995 Yuen
D360,049 S 7/1995 Shemitz
D360,480 S 7/1995 Hon
D362,314 S 9/1995 Shemitz
D366,337 S 1/1996 Yuen
5,595,436 A 1/1997 Way, Jr. et al.
5,620,247 A * 4/1997 Swanson ..... 362/249.08
D386,278 S 11/1997 Engle et al.
5,690,418 A 11/1997 Hsiung
5,765,939 A 6/1998 Tanner, Jr.
5,769,529 A 6/1998 Weinstock et al.
D397,478 S 8/1998 Booty, Jr.
5,871,274 A 2/1999 Lee et al.
D408,567 S 4/1999 Coe
5,934,787 A 8/1999 Sharma
D415,304 S 10/1999 Brown
6,022,119 A 2/2000 Booty, Jr.
D423,130 S 4/2000 Kung
D424,223 S 5/2000 Fun
D432,696 S 10/2000 Ford
6,146,001 A 11/2000 Cwiakala
D435,677 S 12/2000 Hollinger
6,206,541 B1 3/2001 Landamia
D440,692 S 4/2001 Janos et al.
D446,877 S 8/2001 Lester
6,390,652 B1 5/2002 Echito
6,406,161 B1 6/2002 Lin et al.
D464,162 S 10/2002 Segretto
D469,560 S 1/2003 Nayler et al.
D470,262 S 2/2003 Yiu
6,536,924 B2 3/2003 Segretto
6,566,824 B2 5/2003 Panagotacos et al.
D476,106 S 6/2003 Kim
6,588,920 B2 7/2003 Agro
6,619,813 B1 9/2003 Schnell
6,641,283 B1 11/2003 Bohler
6,726,502 B1 4/2004 Hayes
6,736,531 B2 * 5/2004 Wallach ..... 362/414
D490,925 S 6/2004 Wilmotte
6,827,465 B2 12/2004 Shemitz et al.
6,877,875 B2 4/2005 Yu et al.
D506,560 S 6/2005 Oas
D507,373 S 7/2005 Kim
D508,582 S 8/2005 Nayler et al.
6,955,442 B1 10/2005 Chan
6,979,107 B1 12/2005 Benensohn
6,984,054 B2 * 1/2006 Lai ..... 362/199
D521,171 S 5/2006 Skegin
D522,678 S 6/2006 Wang
D522,679 S 6/2006 Hodgson
D523,984 S 6/2006 Cai
7,066,619 B2 6/2006 Waters
D525,381 S 7/2006 Hodgson
D526,433 S 8/2006 Li
D527,131 S 8/2006 McCarthy, III
D536,813 S 2/2007 Yuen
D537,186 S 2/2007 Weddell
D542,455 S 5/2007 Newcomb
D542,457 S 5/2007 Fisherman et al.
D543,304 S 5/2007 Chan
D549,382 S 8/2007 Lee
7,270,443 B2 9/2007 Kurtz et al.
D560,014 S 1/2008 Lammel et al.
D561,925 S 2/2008 Levine
D563,013 S 2/2008 Levine
D563,014 S 2/2008 Levine
D563,582 S 3/2008 Levine
D564,118 S 3/2008 Wu
D567,423 S 4/2008 Shen
D576,334 S 9/2008 Levine
D576,338 S 9/2008 Levine
D578,246 S 10/2008 Levine
D578,703 S 10/2008 Levine
D581,077 S 11/2008 Levine
D581,569 S 11/2008 Levine
D581,570 S 11/2008 Levine
D581,571 S 11/2008 Levine
D581,572 S 11/2008 Levine
7,578,598 B2 * 8/2009 Robinson et al. ..... 362/183
7,591,572 B1 9/2009 Levine
7,648,261 B2 * 1/2010 Ko et al. ..... 362/396
2001/0009511 A1 7/2001 Griffiths
2002/0145876 A1 10/2002 Juang
2003/0179572 A1 9/2003 Schnell
2004/0240090 A1 12/2004 Skiver et al.
2005/0007778 A1 1/2005 Lin
2006/0050519 A1 3/2006 Lin
2006/0092637 A1 5/2006 Yeh
2006/0250789 A1 11/2006 Coushaine
2006/0256584 A1 11/2006 Paoluccio
2007/0070645 A1 3/2007 Coushaine et al.
2007/0097689 A1 5/2007 Barausky et al.
2008/0137326 A1 6/2008 Levine
2009/0040774 A1 * 2/2009 Avila et al. ..... 362/371

* cited by examiner

LIGHTING DEVICE

FIELD

This disclosure concerns lighting devices, such as lighting devices that are collapsible into compact configurations.

BACKGROUND

Several varieties of collapsible lighting devices are known. For example, U.S. Pat. No. 5,169,226 (US'226) discloses a "portable desk light" including "a flat thin battery case with laterally spaced battery chambers defining an upwardly opening channel therebetween." US'226, abstract. The upwardly opening channel "receives an elongate support arm" with a pivot point at one end and a lamp housing at the opposite end. US'226, abstract and FIG. 1. Similarly, U.S. Pat. No. D278,461 (US'461) discloses a "sun lamp" including a base with a channel configured to receive a portion of a support arm connected to a lamp housing. US'461, title and FIG. 1.

The lighting devices disclosed in US'226 and US'461 are limited, in part, because their lamp housings are only rotatable around a single axis. In both cases, the lamp housings are only rotatable around an axis perpendicular to the long axis of the associated support arm. US'226, FIG. 1 and US'461, FIG. 1. This limits a user's ability to direct light to areas on either side of the lighting device.

SUMMARY

Disclosed herein are embodiments of a highly versatile collapsible lighting device. Some embodiments include an elongated light bar and a base having an elongated groove shaped to receive the elongated light bar. The elongated light bar can be maneuverable relative to the base so as to allow a user to modify the direction of emitted light. For example, the elongated light bar can include a hinged connection to the base. The hinged connection can be positioned closer to one end of the elongated groove than to an opposite end of the elongated groove. Typically, the hinged connection is positioned within the elongated groove. The elongated light bar can be rotatable at the hinged connection around an axis substantially perpendicular to the long axis of the elongated light bar. In some embodiments, rotation of the elongated light bar around this axis is restricted to a range of less than about 180 degrees.

The lighting device can be convertible into a compact configuration with at least a portion of the elongated light bar positioned within the elongated groove. Rotation of the elongated light bar at the hinged connection can be used to move the elongated light bar into and out of the elongated groove, thus converting the lighting device between compact and expanded configurations. In some embodiments, the base is elongated and the long axis of the elongated light bar is substantially parallel to the long axis of the base when the lighting device is in the compact configuration.

For greater maneuverability, the elongated light bar can include a light source housing portion rotatable around an axis substantially parallel to the long axis of the elongated light bar. In some embodiments, rotation of the light source housing portion around this axis is restricted to a range of less than about 360 degrees. The light source housing portion can include two or more light emitting diodes positioned along the long axis of the elongated light bar. For example, the light emitting diodes can be positioned behind a substantially transparent window. The length of the substantially transparent window can be between about 50% and about 100% of the length of the elongated light bar.

Embodiments of the disclosed lighting device can include a variety of additional features. For example, the base can include a battery compartment, a DC power port, or both. The base also can include a hook adjacent to one of its ends. This hook can be rotatable into a hook recess within the base when not in use. In some embodiments, the elongated groove within the base includes one open end such that one end of the elongated light bar is exposed when the lighting device is in the compact configuration. For example, the elongated light bar can include a portion that projects beyond the open end of the elongated groove when the lighting device is in the compact configuration.

Also disclosed are embodiments of a lighting device kit. These embodiments can include the disclosed lighting device and a mounting sleeve. The lighting device can be configured to slide into or out of the mounting sleeve without the use of tools. For example, the mounting sleeve can be shaped to receive one end of the base. The mounting sleeve can include an opening positioned to prevent the mounting sleeve from obstructing rotation of the elongated light bar away from the base when the lighting device is positioned within the mounting sleeve. Embodiments of the disclosed lighting device kit also can include an electrical adaptor configured to electrically connect the lighting device to an electrical receptacle.

DETAILED DESCRIPTION

Figure 1:
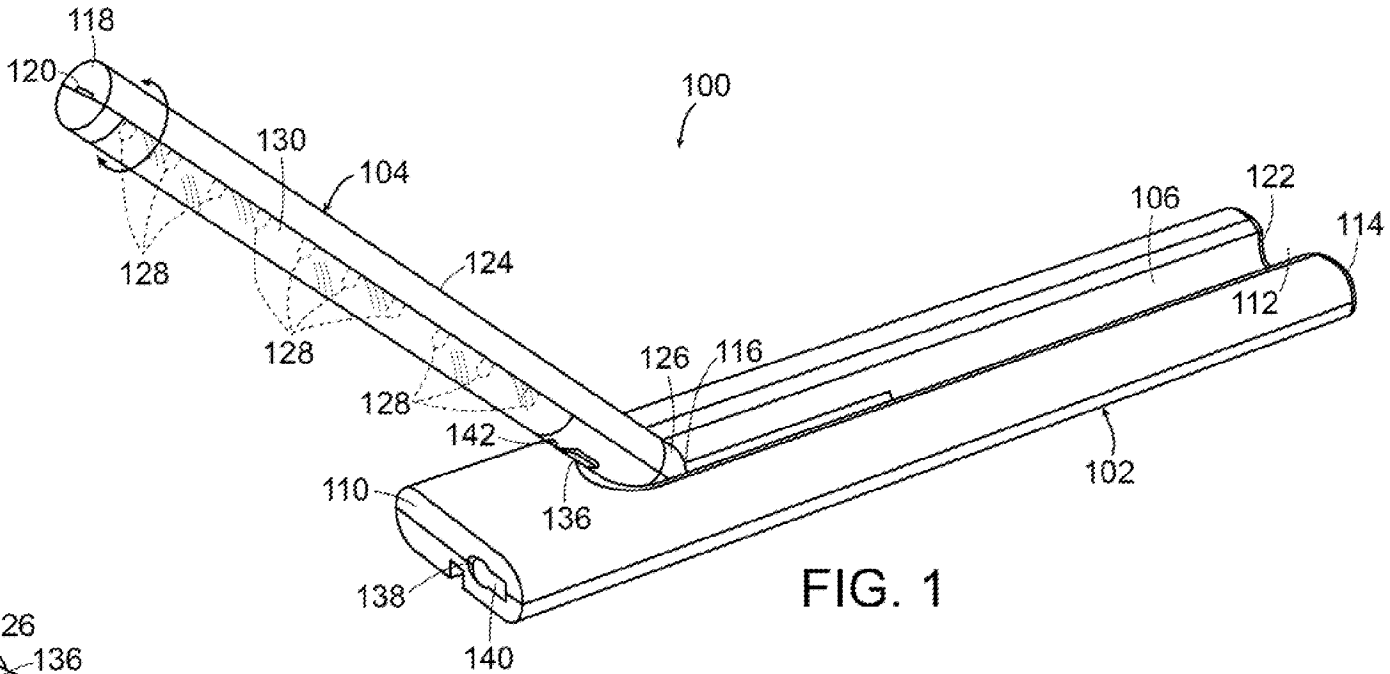
FIG. 1 is a perspective view of one embodiment of the disclosed lighting device in an expanded configuration with its light bar extended away from a groove within its base.

Throughout this disclosure, the singular terms "a," "an," and "the" include plural referents unless the context clearly indicates otherwise. Similarly, the word "or" is intended to include "and" unless the context clearly indicates otherwise. As used herein the word "connected" does not exclude the presence of one or more intervening elements. The word "rotatable" means capable of pivoting at least five degrees around an axis unless the context clearly indicates otherwise. Directional terms, such as "upper," "lower," "front," "back,"

"vertical," and "horizontal," are used herein to express and clarify the relationship between various elements. It should be understood that such terms do not denote absolute orientation (e.g., a "vertical" component can become horizontal by rotating the device).

Described herein are embodiments of a lighting device and embodiments of a lighting device kit. Some embodiments include a light bar connected to a base. The light bar, for example, can be stowed within a groove in the base or rotated away from the base about a pivot point at or near one end of the light bar. Rotating the light bar away from the base in this manner allows a user to change the direction of emitted light. In some embodiments, a light source housing portion of the light bar is rotatable around an axis substantially parallel to a long axis of the light bar. In combination, rotating the light bar away from the base and rotating the light source housing around the axis substantially parallel to the long axis of the light bar allows a user to direct light toward virtually any area in the vicinity of the lighting device.

FIGS. 1-7 illustrate one embodiment of the disclosed lighting device 100. The illustrated lighting device 100 includes a base 102 and a light bar 104. The base 102 and the light bar 104 are both elongated. In a cross sectional plane perpendicular to its length, the base 102 is shaped substantially as a rectangle with its short sides rounded into semicircles. The base 102 includes a groove 106 recessed into its top surface. The groove 106 extends between a closed end 108 near a first end 110 of the base 102 and an open end 112 at a second end 114 of the base. Other embodiments can have bases with different shapes. Some embodiments have bases that are not elongated. For example, these embodiments can have bases with top surfaces that are substantially round or substantially shaped as a non-elongated polygon, such as a square or a triangle. In embodiments having elongated bases, the bases can have cross sections in planes perpendicular to their lengths that substantially resemble, for example, a polygon (e.g., a parallelogram, a pentagon, a hexagon, a heptagon, or an octagon), a circle, an oval, or a circular segment (e.g., a semicircle). The base 102 in the illustrated lighting device 100 is primarily made of plastic. In other embodiments, the base can be primarily made of another material such as metal.

The light bar 104 is cylindrical with a curvature to which the groove 106 closely conforms. In other embodiments, the light bar and/or the groove can have different shapes. For example, the light bar and/or the groove can have cross sections in planes perpendicular to their lengths that substantially resemble a polygon (e.g., a parallelogram, a pentagon, a hexagon, a heptagon, or an octagon), a circle, an oval, or a circular segment (e.g., a semicircle). In FIGS. 2-5, the light bar 104 is shown stowed in the groove 106 such that a majority of the light bar is recessed below the top surface of the base 102. In this configuration, the light bar 104 and the base 102 are elongated in substantially the same direction.

Figure 7:
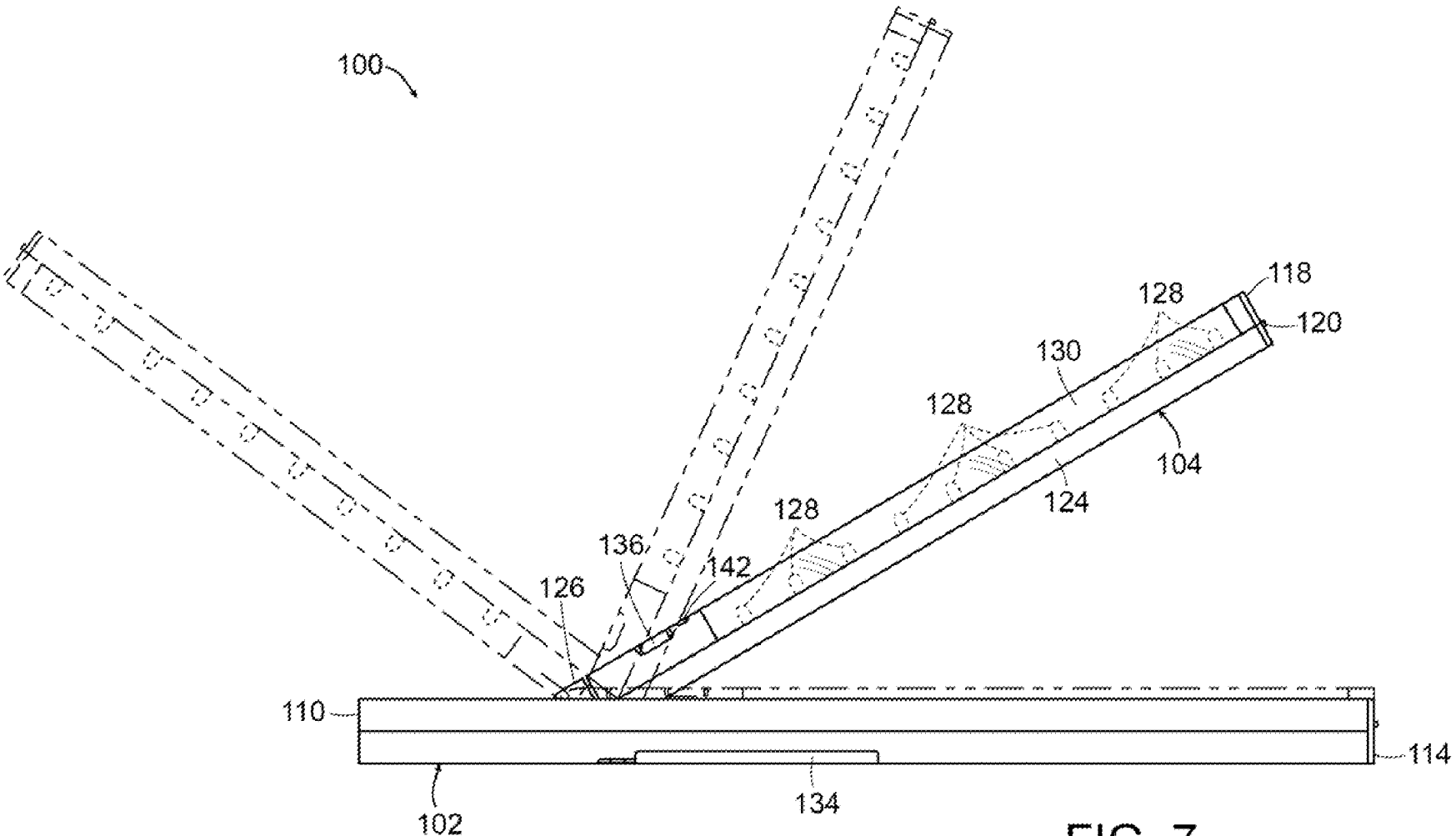
FIG. 7 is a side elevation view of the embodiment shown in FIG. 1 with its light bar partially extended away from the groove and showing the range of motion of the light bar relative to the base around, one axis.

As best shown in FIGS. 1 and 7, the light bar 104 is rotatable relative to the base 102 about a hinged connection. The hinged connection is positioned near a first end 116 of the light bar 104. In the illustrated lighting device 100, the hinged connection includes an axle (not shown) extending through the light bar 104 and into opposing sides of the groove 106. Other embodiments can include hinged connections with different mechanisms for allowing rotation. For example, the hinged connections in other embodiments can include a ball bearing. As shown in FIG. 7, the light bar 104 is rotatable relative to the base 102 through an arc of approximately 140 degrees. The closed end 108 of the groove 106 blocks further rotation of the light bar 104 relative to the base 102. In embodiments of the disclosed lighting device, rotation of the light bar relative to the base typically is restricted to a range of less than about 180 degrees, such as less than about 160 degrees or less than about 150 degrees.

A second end 118 of the light bar 104 opposite to the first end 116 of the light bar is substantially flush with the second end 114 of the base 102 when the light bar is stowed within the groove 106. A grip tab 120 on the second end 118 of the light bar 104, however, projects slightly beyond the second end 114 of the base 102. The grip tab 120 allows a user to more easily apply pressure to cause the light bar 104 to rotate away from the base 102 about the hinged connection. In other embodiments, the light bar can have a length greater than the length of the groove, such that the second end of the light bar extends beyond the second end of the base. In these embodiments, a grip tab is generally unnecessary because a user can easily grip the portion of the light bar extending beyond the second end of the base to rotate the light bar away from the base.

Figure 5:
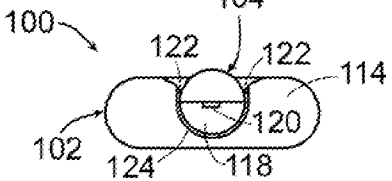
FIG. 5 is a second end elevation view of the embodiment shown in FIG. 1 in the compact configuration.

As shown in FIG. 5, bumps 122 are positioned on either side of the groove 106 near the open end 112 of the groove. The bumps 122 help to hold the light bar 104 in place while the light bar is stowed within the groove 106. Moving the light bar 104 into or out of the groove 106 causes the bumps 122 to briefly press against the widest portion of the light bar. This interaction between the bumps 122 and the light bar 104 causes a user to experience a slight snapping sensation when the light bar moves into or out of the groove 106.

The overall light bar 104 is divided along its length into a light source housing portion 124 and a connector portion 126. The light source housing portion 124 includes ten lighting elements 128 arranged in a row substantially parallel to the length of the light bar 104. In other embodiments, the light source housing portion can include one, two, three, four, five, six, seven, eight, nine, eleven, twelve, or a greater number of lighting elements. In embodiments that include multiple lighting elements, the lighting elements can be arranged in a variety of configurations. For example, the lighting elements can be arranged in clusters or in a staggered pattern.

In the illustrated lighting device 100, the lighting elements 128 are white light-emitting diodes. In other embodiments the lighting elements can be incandescent, fluorescent, halogen, xenon, neon, or some other commercially available lighting type. Light-emitting diodes are particularly well suited for use in disclosed embodiments due to their compact size, low power demand, low heat output, long life, and high durability. Instead of white light-emitting diodes, other embodiments can include light-emitting diodes of another color, such as red, orange, yellow, green, or blue.

A window 130 extends along the majority of one side of the light source housing portion 124 of the light bar 104. The window 130 of the illustrated lighting device 100 is made of clear plastic. Other embodiments can have windows made of glass or another substantially optically transmissive material. The majority of the inside surface of the window 130 of the lighting device 100 is coated to give it a slightly frosted appearance. The window 130 also includes uncoated regions (not shown) directly above each of the individual lighting elements 128. To further promote the transmission of light, the lighting elements 128 are mounted on a reflective backing (not shown).

The light source housing portion 124 is rotatable relative to the connector portion 126 and the base 102 around an axis substantially parallel to the length of the light bar 104. Some disclosed embodiments include a stop at the connection point between the light source housing portion and the connector portion that prevents the light source housing portion from rotating more than about 360 degrees relative to the connector portion. The stop can include, for example, two overlapping projections connected to the light source housing portion and the connector portion, respectively. Including a stop can help to prevent wires (not shown) extending between the base and the lighting elements from becoming tangled or breaking from excess tension.

Figure 6:
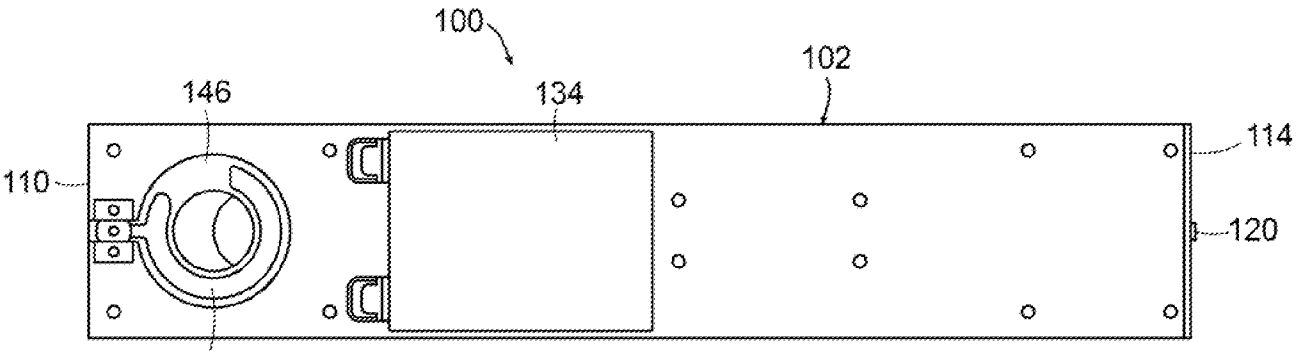
FIG. 6 is a bottom plan view of the embodiment shown in FIG. 1 in the compact configuration.
Figure 8:
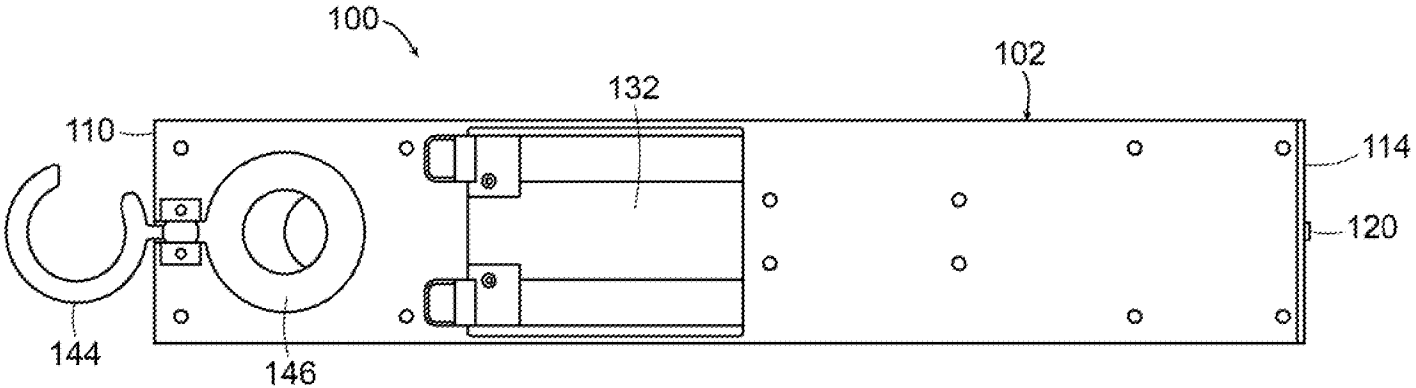
FIG. 8 is a bottom plan view of the embodiment shown in FIG. 1 in the compact configuration with its hook extended away from a hook recess within the base and its battery compartment uncovered.
Figure 9:
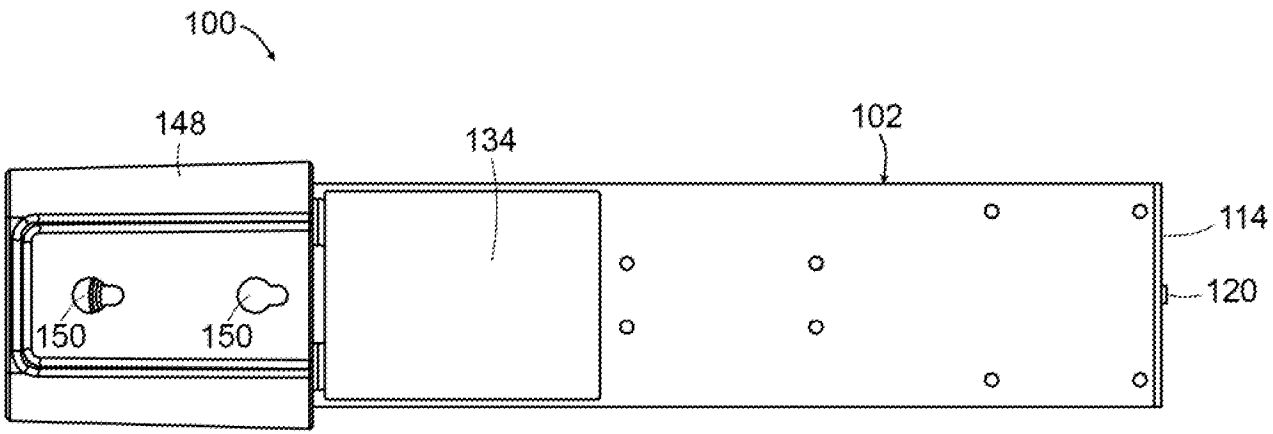
FIG. 9 is a bottom plan view of the embodiment shown in FIG. 1 in the compact configuration with one end of the lighting device positioned within the mounting sleeve.

FIGS. 6, 8 and 9 are plan views of the bottom surface of the base 102 of the lighting device 100. The base 102 includes a battery compartment 132 positioned behind a detachable battery compartment cover 134. Within the base 102, wires (not shown) extend from the battery compartment 132 to the lighting elements 128 along the light source housing portion 124 of the light bar 104. A power button 136 located on the light bar 104 controls the flow of electricity between batteries (not shown) within the battery compartment 132 and the lighting elements 128

The battery compartment 132 of the lighting device 100 is configured to hold six size AA batteries with the long axis of each battery substantially parallel to the long axis of the base 102. The battery compartment 132 is configured so that installed batteries are electrically connected in series with soldered connections (not shown) at the beginning and end of the series. Wires (not shown) extend between the soldered connections of the battery compartment 132 and contacts on backing plates (not shown) of the lighting elements 128. The backing plates are connected to a circuit board (not shown) that controls the flow of electricity to the lighting elements 128 in response to signals from the power button 136.

In addition to or instead of using battery power, the illustrated lighting device 100 can use power drawn from a standard electrical receptacle. When the lighting device 100 begins receiving power from an electrical receptacle, power draw from batteries within the battery compartment 132 automatically ceases to preserve battery life. A DC port 138 located on the first end 110 of the base 102 includes an opening (not shown) and a rubberized plug 140 that can be positioned within the opening when not in use. To power the lighting device 100 from an electrical receptacle, the rubberized plug 140 can be removed from the opening, one end of a power converter (not shown) can be plugged into the electrical receptacle, and the other end of the power converter can be plugged into the opening. When the lighting device 100 is connected to an electrical receptacle an indicator light 142 on the light bar 104 is illuminated.

Other embodiments can include different electrical configurations. Embodiments powered exclusively or optionally by batteries can include any number, type, and arrangement of batteries, such four AA batteries in series or one nine-volt battery directly connected to the circuit. The batteries can be housed in one, two, three, four, or a greater number of battery compartments. Other embodiments can be hard wired to a permanent power source, such as a wall circuit. Embodiments that can be plugged into a standard electrical receptacle can include an electrical cord permanently or removably attached to the lighting device. Hard-wired and plug-in embodiments can include an adaptor to modify the voltage of a conventional wall circuit. Such an adaptor can be positioned, for example, within the base of the lighting device or along a cord attached to the lighting device.

In the illustrated lighting device 100, the power button 136 turns the lighting elements 128 either on or off. Other embodiments can have a power button configured to toggle the lighting elements between different levels of light Intensity. For example, a single press of the power button can turn on the lighting elements, a second press of the power button can increase the light intensity, and a third press of the power button can turn off the lighting elements. Alternatively, the power button can be configured to toggle between the activation of different numbers of lighting elements from among a plurality of lighting elements. For example, a single press of the power button can turn on every-other lighting element, a second press of the power button can turn on all of the lighting elements, and a third press of the power button can turn off all of the lighting elements. The functionality of toggling the light intensity or the number of illuminated lighting elements can be incorporated by including a commercially available dimmer or toggle switch on a circuit board electrically connected to the lighting elements. Instead of a power button, other embodiments can include another type of switch, such as a toggle switch, a rocker switch, or a dial. Such switches can be positioned, for example, on a portion of the lighting device other than the light bar, such as on the base or on a separate unit connected to the base.

The lighting device 100 can be installed and used in a variety of orientations. For example, the lighting device 100 can be installed and used with the base 102 oriented substantially horizontally and the groove 106 facing upward, such as by resting the lighting device on a substantially flat surface (e.g., the surface of a desk). Alternatively, the lighting device 100 can be installed and used with the base 102 oriented substantially horizontally and the groove 106 facing downward, such as by mounting the lighting device to the underside of a substantially flat surface (e.g., the underside of a kitchen cabinet). The lighting device 100 also can be installed and used with the base 102 oriented substantially vertically. For example, the lighting device 100 can be mounted to a substantially vertical wall with the groove 106 facing away from the wall. The illustrated lighting device 100 includes a hook 144 that facilitates hanging the lighting device with the base 102 oriented substantially vertically. In FIG. 8, the hook 144 is shown projecting out from the first end 110 of the base 102. When not in use, the hook 144 can be rotated from its extended position to stow within the base 102 in a hook recess 146.

Figure 2:
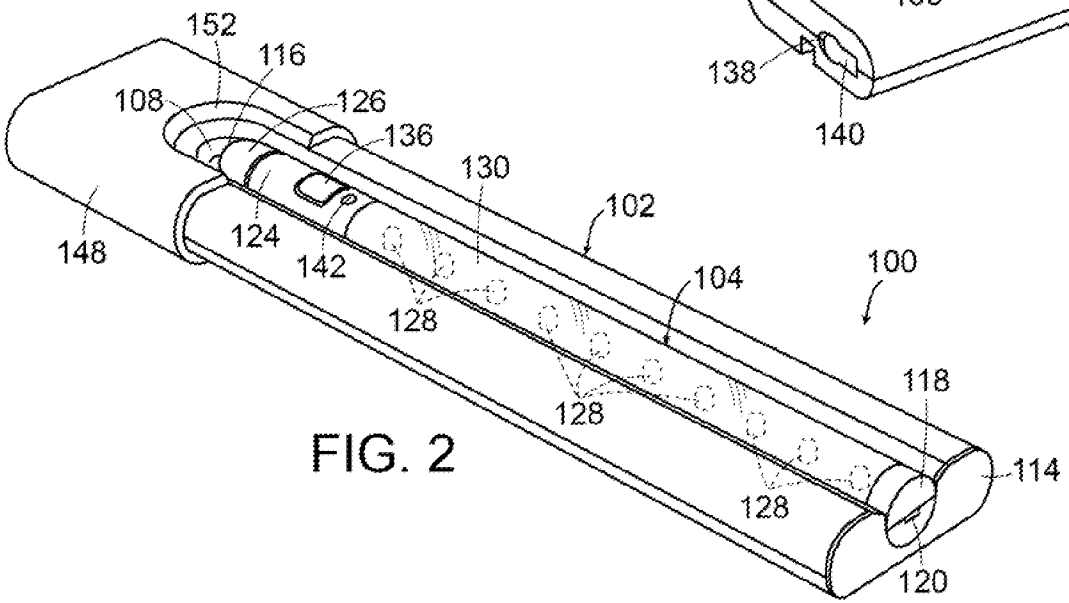
FIG. 2 is a perspective view of the embodiment shown in FIG. 1 in a compact configuration with its light bar positioned partially within the groove and one end of the lighting device positioned within a mounting sleeve.
Figure 3:
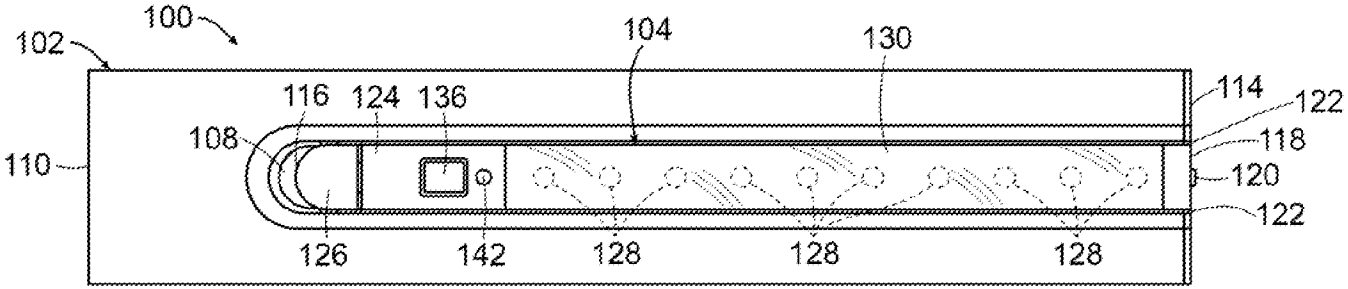
FIG. 3 is a top plan view of the embodiment shown in FIG. 1 in the compact configuration.
Figure 4:
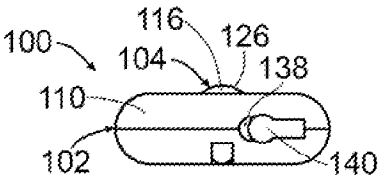
FIG. 4 is a first end elevation view of the embodiment shown in FIG. 1 in the compact configuration.

The lighting device 100 can be used in conjunction with a mounting sleeve 148 shown in FIGS. 2 and 9. As shown in FIG. 9, the mounting sleeve 148 includes two mounting holes 150. The mounting holes 150 can receive the heads of screws or other fasteners attached to a mounting surface. Other embodiments of the mounting sleeve can include a different number of mounting holes (e.g., one, three, four, or five) or a completely different mounting mechanism. Alternative mounting mechanisms can include, for example, magnetic material, hook and loop material, or tape attached to the mounting sleeve. The mounting material (e.g., magnetic material, hook and loop material, or tape) can be placed within a recessed portion of the mounting sleeve so that the mounting sleeve can be mounted substantially flush to the mounting surface. In addition to or instead of a mounting mechanism on an associated mounting sleeve, embodiments of the disclosed lighting device can include a similar mounting mechanism positioned directly on the bottom surface of the base.

When used in conjunction with the mounting sleeve 148, the illustrated lighting device 100 can be mounted and unmounted without the use of tools. Thus, the lighting device 100 can be used while positioned within the mounting sleeve 148 or conveniently separated from the mounting sleeve and used at a different location. As shown in FIG. 2, the mounting sleeve 148 includes an opening 152 adjacent to the first end 116 of the light bar 104 when the lighting device 100 is positioned within the mounting sleeve. The opening 152 prevents the mounting sleeve 148 from obstructing rotation of the light bar 104 away from the base 102 when the lighting device 100 is positioned within the mounting sleeve. In some embodiments, the mounting sleeve is connected to a wall circuit and acts as a recharging station for the associated lighting device. For example, the mounting sleeve can include a contact element positioned to insert into the opening of the DC port on the first end of the base of the lighting device when the lighting device is inserted into the mounting sleeve. Rechargeable batteries within the lighting device can be configured to draw power from the DC port.

Embodiments of the disclosed lighting device can include a variety of features in addition to or in place of the features described above and shown in FIGS. 1-9. For example, some embodiments include a sensor that activates and/or deactivates the lighting elements. In some embodiments, this sensor is a light sensor, such as a commercially available light sensor that activates the lighting elements when light from another source is detected. This can be useful for applications in which the disclosed lighting device is not the primary lighting device for an area. Once the primary lighting device for an area (e.g., an overhead light) is activated, embodiments of the disclosed lighting device can be configured to activate automatically. In this way, secondary lighting, such as accent lighting, can be activated without the need for manual intervention. By the same principle, the lighting device can be activated by a motion sensor, such as a commercially available motion sensor. Embodiments including a sensor also can include a manual override switch to deactivate the sensor when automatic operation is not desirable. The manual override switch can be, for example, a commercially available switch that switches the flow of electrical current between a circuit including the sensor and a circuit not including the sensor.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A lighting device, comprising:

a base having an elongated groove with a first end and a second end; and an elongated light bar, wherein the elongated light bar includes a hinged connection to the base, the hinged connection is positioned closer to the first end of the elongated groove than to the second end of the elongated groove, the elongated light bar is rotatable at the hinged connection around a first rotation axis substantially perpendicular to a long axis of the elongated light bar, a light source housing portion of the elongated light bar is rotatable around a second rotation axis substantially parallel to the long axis of the elongated light bar, and the lighting device is convertible into a compact configuration with at least a portion of the elongated light bar positioned within the elongated groove.

2. The lighting device according to claim 1, wherein the hinged connection is positioned within the elongated groove.

3. The lighting device according to claim 1, wherein the base is elongated and the long axis of the elongated light bar is substantially parallel to a long axis of the base when the lighting device is in the compact configuration.

4. The lighting device according to claim 1, wherein rotation of the elongated light bar around the first rotation axis is restricted to a range of less than about 180 degrees.

5. The lighting device according to claim 1, wherein rotation of the light source housing portion around the second rotation axis is restricted to a range of less than about 360 degrees.

6. The lighting device according to claim 1, wherein the base includes a battery compartment.

7. The lighting device according to claim 1, wherein the base includes a DC power port.

8. The lighting device according to claim 1, wherein the base has a first end and a second end, the second end of the base is adjacent to the second end of the elongated groove, and the lighting device further comprises a hook adjacent to the first end of the base.

9. The lighting device according to claim 8, wherein the hook is rotatable into a hook recess within the base.

10. The lighting device according to claim 1, wherein the light source housing portion includes two or more light emitting diodes positioned along the long axis of the elongated light bar.

11. The lighting device according to claim 10, wherein the light emitting diodes are positioned behind a substantially transparent window, and the length of the substantially transparent window is between about 50% and about 100% of the length of the elongated light bar.

12. The lighting device according to claim 1, wherein the second end of the elongated groove is open such that the second end of the elongated light bar is exposed when the lighting device is in the compact configuration.

13. The lighting device according to claim 12, wherein a portion of the elongated light bar projects beyond the second end of the elongated groove when the lighting device is in the compact configuration.

14. A lighting device kit, comprising:

a lighting device including a base having an elongated groove with a first end and a second end, and an elongated light bar; and a mounting sleeve, wherein the elongated light bar includes a hinged connection to the base, the hinged connection is positioned closer to the first end of the elongated groove than to the second end of the elongated groove, the elongated light bar is rotatable at the hinged connection around a first rotation axis substantially perpendicular to a long axis of the elongated light bar, a light source housing portion of the elongated light bar is rotatable around a second rotation axis substantially parallel to the long axis of the elongated light bar, the lighting device is convertible into a compact configuration with at least a portion of the elongated light bar positioned within the elongated groove, and the lighting device is configured to slide into or out of the mounting sleeve without the use of tools.

15. The lighting device kit according to claim 14, wherein the base has a first end and a second end, the second end of the base is adjacent to the second end of the elongated groove, and the mounting sleeve is configured to receive the first end of the base.

16. The lighting device kit according to claim 14, wherein the mounting sleeve includes an opening, and rotation of the elongated light bar around the first rotation axis causes a portion of the elongated light bar to move into the opening.

17. The lighting device kit according to claim 14, wherein the lighting device kit further comprises an electrical adaptor configured to electrically connect the lighting device to an electrical receptacle.

18. A lighting device, comprising:

a base having an elongated groove;

an elongated light bar;

first hinge means for allowing the elongated light bar to rotate relative to the base around a first rotation axis substantially perpendicular to a long axis of the elongated light bar; and second hinge means for allowing a light source housing portion of the elongated light bar to rotate relative to the base around a second rotation axis substantially parallel to the long axis of the elongated light bar, wherein the lighting device is convertible into a compact configuration with at least a portion of the elongated light bar positioned within the elongated groove.

19. The lighting device according to claim 18, further comprising power means for providing power to lighting elements positioned within the light source housing portion.

20. The lighting device according to claim 18, further comprising mounting means for attaching the lighting device to amounting surface.

* * * * *